US011100869B2

(12) United States Patent
Nakayama

(10) Patent No.: US 11,100,869 B2
(45) Date of Patent: Aug. 24, 2021

(54) SEMICONDUCTOR APPARATUS FOR DRIVING DISPLAY DEVICE

(71) Applicant: LAPIS SEMICONDUCTOR CO., LTD, Yokohama (JP)

(72) Inventor: Akira Nakayama, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

(21) Appl. No.: 16/660,782

(22) Filed: Oct. 22, 2019

(65) Prior Publication Data

US 2020/0135119 A1 Apr. 30, 2020

(30) Foreign Application Priority Data

Oct. 26, 2018 (JP) ..... JP2018-202120

(51) Int. Cl.
*G09G 3/3291* (2016.01)
*G09G 3/3233* (2016.01)
(Continued)

(52) U.S. Cl.
CPC ..... *G09G 3/3291* (2013.01); *G09G 3/2003* (2013.01); *G09G 3/2007* (2013.01);
(Continued)

(58) Field of Classification Search
CPC .. G09G 3/3291; G09G 3/3233; G09G 3/2007; G09G 3/2003; G09G 3/3266; G09G 2320/0276; G09G 2320/0242; G09G 2310/0291; G09G 2320/0646; G09G 2330/028; G09G 2320/0223; G09G 2320/0209; G09G 2320/0233;
(Continued)

(56) References Cited

U.S. PATENT DOCUMENTS 10,043,454 B2 * 8/2018 Nakagawa ..... G09G 3/3258
10,878,767 B2 * 12/2020 Morita ..... G09G 3/3696
(Continued)

FOREIGN PATENT DOCUMENTS

JP 2016206283 12/2016
KR 20060116587 A * 11/2006

*Primary Examiner* — Rodney Amadiz
(74) *Attorney, Agent, or Firm* — JCIPRNET

(57) ABSTRACT

A semiconductor apparatus including a driver capable of favorably suppressing image deterioration accompanying a voltage fluctuation even if the voltage fluctuation is generated in a display device is provided. The semiconductor apparatus of the disclosure includes: a gradation voltage generation portion generating a first to kth representative gradation voltage in accordance with gamma characteristics and generating a first to Nth gradation voltage based on the first to kth representative gradation voltage; a driving portion selecting one gradation voltage corresponding to display data from the first to Nth gradation voltage and applying a signal representing the selected one gradation voltage as a driving signal to source lines; and a fluctuating voltage superposition portion generating, when a voltage fluctuation is generated in the power supply voltage for making display cells emit light, a voltage fluctuation corresponding to the voltage fluctuation in at least one of the first to kth representative gradation voltage.

7 Claims, 11 Drawing Sheets

(51) Int. Cl.
*G09G 3/20* (2006.01)
*G09G 3/3266* (2016.01)

(52) U.S. Cl.
CPC ..... *G09G 3/3233* (2013.01); *G09G 3/3266* (2013.01); *G09G 2310/0291* (2013.01); *G09G 2320/0242* (2013.01); *G09G 2320/0276* (2013.01); *G09G 2320/0646* (2013.01); *G09G 2330/028* (2013.01)

(58) Field of Classification Search
CPC ... G09G 2320/0666; G09G 2320/0673; G09G 3/3258; G09G 3/3275; G09G 3/3688; G09G 3/3696
See application file for complete search history.

(56) References Cited

U.S. PATENT DOCUMENTS

| | | | | |
|---|---|---|---|---|
| 2009/0244109 | A1* | 10/2009 | Chen | G09G 3/3648 345/690 |
| 2014/0168043 | A1* | 6/2014 | Zhang | G09G 3/3692 345/90 |
| 2015/0356932 | A1* | 12/2015 | Kim | G09G 3/3688 345/690 |
| 2016/0307536 | A1* | 10/2016 | Okabe | G02F 1/1368 |
| 2017/0069284 | A1* | 3/2017 | Wang | G09G 3/3655 |

* cited by examiner

SEMICONDUCTOR APPARATUS FOR DRIVING DISPLAY DEVICE

CROSS-REFERENCE TO RELATED APPLICATION

This application claims the benefit of Japan Application No. 2018-202120, filed on Oct. 26, 2018. The entirety of the above-mentioned patent application is hereby incorporated by reference herein and made a part of this specification.

BACKGROUND

Technical Field

The disclosure relates to a semiconductor apparatus including a display driver which drives a display device according to a video signal.

Related Art

At present, TV or various mobile terminals equipped with a liquid crystal display panel or an organic electroluminescence (hereinafter, referred to as organic EL) display panel as a display device are commercialized.

For example in a liquid crystal display panel which serves as a display device, a plurality of source electrodes and a plurality of gate electrodes are arranged intersecting with each other. In each intersection portion of the source electrodes and the gate electrodes in the liquid crystal display panel, a display element including a capacitive liquid crystal layer sandwiched between a pair of liquid crystal electrodes and a transistor is formed. The source end of the transistor is connected to the source electrode, and the drain end is connected to one of the pair of liquid crystal electrodes. A common voltage is applied to the other of the pair of liquid crystal electrodes.

In addition, a display driver including a gradation voltage generation circuit and a gradation voltage selection circuit is known as the display driver which drives such a liquid crystal display panel (for example, see Japanese Patent Laid-Open No. 2016-206283 (Patent Literature 1)).

The gradation voltage generation circuit includes a ladder resistor configured by connecting a plurality of resistors in series, and obtains a plurality of gradation voltages subjected to gamma correction by selecting a plurality of voltages in accordance with gamma characteristics from a plurality of voltages that includes a voltage on one end of each resistor in the ladder resistor.

The gradation voltage selection circuit selects, from the plurality of gradation voltages, one gradation voltage corresponding to the brightness level represented by display data as the gradation voltage applied to the source electrode and outputs the gradation voltage.

Meanwhile, in the liquid crystal display panel, a voltage value of the gradation voltage applied to a capacitive liquid crystal portion via the source electrode and the transistor may change significantly inside each display element according to contents of the display image, and the common voltage temporarily fluctuates accordingly. Therefore, a fluctuation amount of the common voltage is reflected in the gradation voltage, and there is a risk of image quality deterioration.

Therefore, in the display driver, a difference between the common voltage and the reference voltage of the display device is obtained as the fluctuation amount of the common voltage, and the difference is applied as a correction voltage to one end of a specific resistor in the ladder resistor. Therefore, the voltage value of the gradation voltage that is output from the gradation voltage selection circuit is level shifted by the correction voltage, and the voltage fluctuation occurring in the common voltage is canceled. In this way, the image quality deterioration due to the voltage fluctuation of the common voltage is suppressed.

Meanwhile, in the above display driver, an inverted amplification circuit including an operational amplifier is employed to generate the difference between the common voltage and the reference voltage of the display device as the correction voltage. Therefore, in a period from the occurrence of the voltage fluctuation in the common voltage to the reflection of the fluctuation of the common voltage in the gradation voltage, a delay due to the inverted amplification circuit intervenes in addition to a circuit responsible for gamma correction.

Accordingly, at a head portion of a zone of the voltage fluctuation generated in the common voltage, the voltage fluctuation cannot be canceled, and thus the image quality deterioration cannot be favorably suppressed.

SUMMARY

A semiconductor apparatus according to the disclosure drives a display device including source lines which receive driving signals corresponding to brightness levels represented by display data and including display cells which emit light with brightness corresponding to the driving signals received by the source lines based on a power supply voltage, and the semiconductor apparatus includes: a gradation voltage generation portion generating a first representative gradation voltage to a kth (k is an integer greater than 2) representative gradation voltage in accordance with gamma characteristics and generating a first gradation voltage to an Nth (N is an integer greater than k) gradation voltage based on the first representative gradation voltage to the kth representative gradation voltage; a driving portion selecting one gradation voltage corresponding to the display data from the first gradation voltage to the Nth gradation voltage and applying a signal showing the selected one gradation voltage as the driving signal to the source lines; and a fluctuating voltage superposition portion generating, when a voltage fluctuation occurs in the power supply voltage, a voltage fluctuation corresponding to the voltage fluctuation in at least one of the first representative gradation voltage to the kth representative gradation voltage.

DESCRIPTION OF THE EMBODIMENTS

The disclosure provides a semiconductor apparatus including a driver capable of favorably suppressing image deterioration accompanying a voltage fluctuation even if the voltage fluctuation occurs in a display device.

In the disclosure, the voltage fluctuation the same as the voltage fluctuation generated in the power supply voltage is generated in the representative gradation voltages subjected to gamma correction. In this way, the image quality deterioration accompanying the voltage fluctuation of the power supply voltage can be favorably suppressed.

In the following, embodiments of the disclosure are specifically described with reference to drawings.

Figure 1:
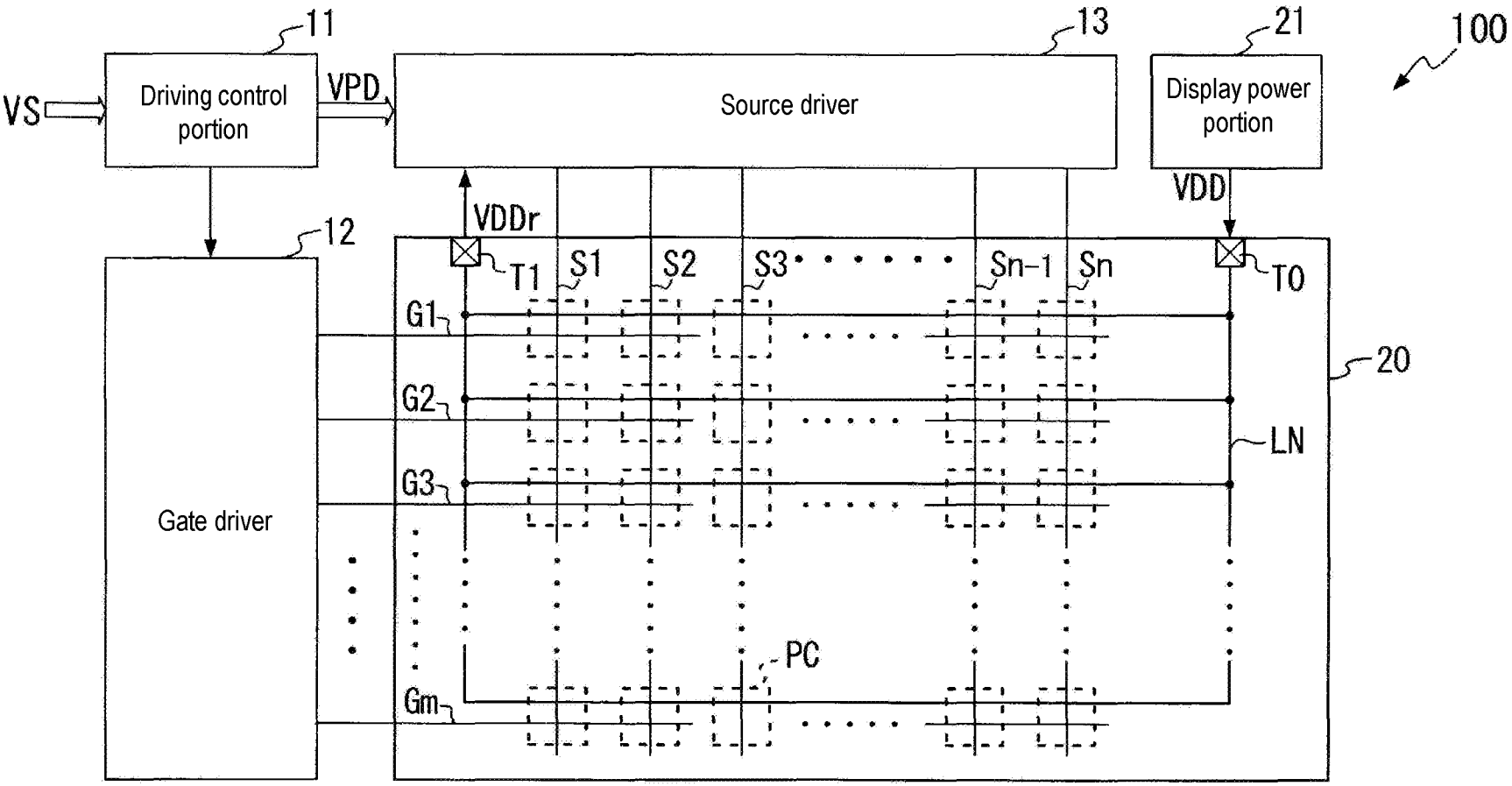
FIG. 1 is a block diagram which shows a configuration of a display apparatus 100 including a source driver 13 serving as a semiconductor apparatus according to the disclosure.

FIG. 1 is a block diagram showing a configuration of a display apparatus 100 including a source driver 13 serving as a semiconductor apparatus according to the disclosure.

The display apparatus 100 includes, in addition to the source driver 13, a driving control portion 11, a gate driver 12, a display device 20 and a display power portion 21.

The display device 20 is, for example, a display panel of an active matrix type in which a plurality of display cells PC respectively including an organic electroluminescence element (hereinafter, simply referred to as EL element) serving as a display element is arranged in a matrix shape.

The display device 20 includes gate lines G1 to Gm (m is an integer greater than 2) respectively extending horizontally in a two-dimensional screen, source lines S1 to Sn (n is an integer greater than 2) respectively extending vertically in the two-dimensional screen, and a power supply line LN. In the display device 20, a display cell PC is formed in each intersection portion (regions surrounded by dashed lines) of the gate lines G1 to Gm and the source lines S1 to Sn. The power supply line LN is connected to all the display cells PC included in the display device 20 and connected to terminals T0 and T1. The terminal T0 is connected to the display power portion 21, and the terminal T1 is connected to the source driver 13.

Figure 2:
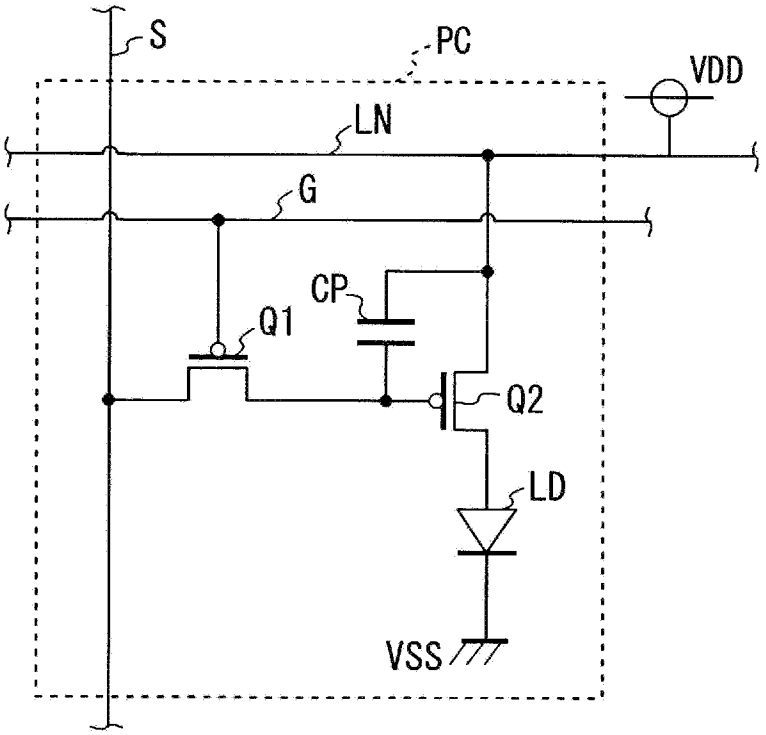
FIG. 2 is a circuit diagram showing a configuration of a display cell PC.

FIG. 2 is a circuit diagram showing a configuration of the display cell PC.

As shown in FIG. 2, the display cell PC includes transistors Q1 and Q2 of a p-channel MOS (metal oxide semiconductor) type, a capacitor CP, and an EL element LD.

The source line S is connected to a source of the transistor Q1, and the gate line G is connected to a gate of the transistor Q1. A first electrode of the capacitor CP for holding driving signals and a gate of the transistor Q2 serving as a driving transistor are connected to a drain of the transistor Q1. A source of the transistor Q2 and the power supply line LN are connected to a second electrode of the capacitor CP. An anode of the EL element LD is connected to a drain of the transistor Q2. A ground potential VSS is applied to a cathode of the EL elements LD.

According to the configuration, the transistor Q1 of the display cell PC is in an on-state when receiving a selection signal of logic level 0 via the gate line G, and supplies a driving signal received via the source line S to the gate of the transistor Q2 and the capacitor CP. In this way, the capacitor CP holds charges corresponding to a gradation voltage represented by the driving signal. In addition, the transistor Q2 generates, based on a power supply voltage VDD received via the power supply line LN, a driving current of a current amount corresponding to the charges held in the capacitor CP, and supplies the driving current to the anode of the EL element LD. The EL element LD emits light at a brightness corresponding to the current amount of the driving current.

In FIG. 1, the display power portion 21 generates the power supply voltage VDD with a constant voltage value for making the EL elements included in respective display cells PC emit light and applies the power supply voltage VDD to the terminal T0 of the display device 20. In this way, the power supply voltage VDD is supplied to all the display cells PC included in the display device 20 via the terminal T0 and the power supply line LN, and a voltage on the power supply line LN is supplied to the source driver 13 via the terminal T1 as a feedback power supply voltage VDDr. Furthermore, the display power portion 21 is formed in a semiconductor chip in which the source driver 13 is formed or another semiconductor chip different from this semiconductor chip.

The driving control portion 11 receives a video signal VS and detects a horizontal synchronization signal from the video signal VS to supply the horizontal synchronization signal to the gate driver 12. In addition, the driving control portion 11 generates, based on the video signal VS, an image data signal VPD including a series of display data pieces that representing the brightness level of each display cell PC by, for example, 8-bit gradation and supplies the same to the source driver 13.

The gate driver 12 sequentially and selectively applies, according to the horizontal synchronization signal, a selection signal including a selection pulse having a peak voltage corresponding to the logic level 0 to each of the gate lines G1 to Gm.

The source driver 13 converts, for n display data pieces of one horizontal scanning in the series of the display data pieces included in the image data signal VPD, each display data piece to a gradation voltage corresponding to a brightness level represented by this display data piece. Then, the source driver 13 generates n driving signals having gradation voltages corresponding to each of the n display data pieces and supplies the same to the source lines S1 to Sn of the display device 20, respectively. Furthermore, the source driver 13 is formed in a single semiconductor chip or being divided into a plurality of semiconductor chips.

Figure 3:
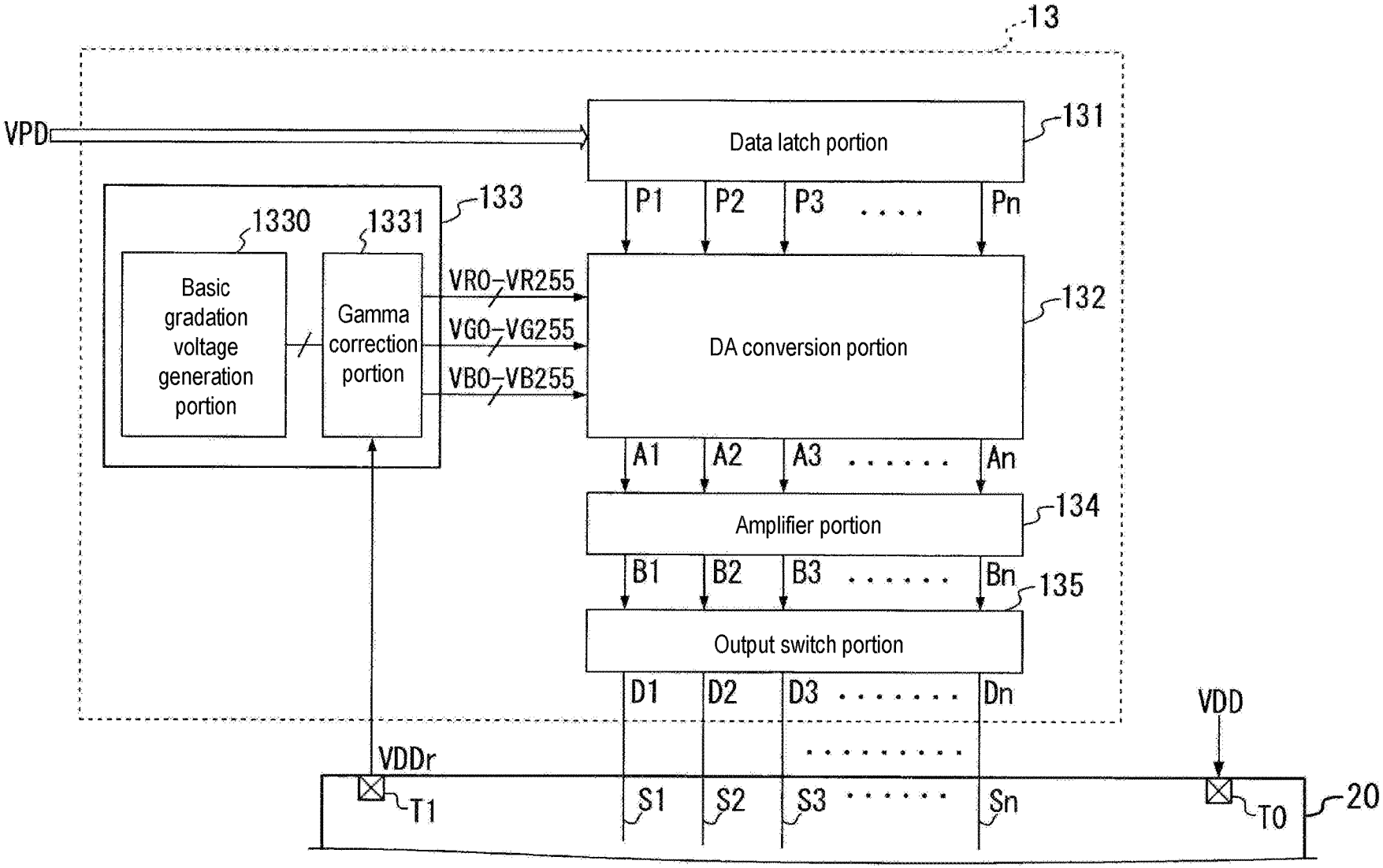
FIG. 3 is a block diagram showing an internal configuration of the source driver 13.

FIG. 3 is a block diagram showing one example of an internal configuration of the source driver 13.

As shown in FIG. 3, the source driver 13 includes a data latch portion 131, a digital analog (DA) conversion portion 132, a gradation voltage generation portion 133, an amplifier portion 134, and an output switch portion 135.

The data latch portion 131 incorporates the series of the display data pieces included in the image data signal VPD into every n display data pieces of one horizontal scanning and supplies the same as display data P1 to Pn to the DA conversion portion 132.

The gradation voltage generation portion 133 includes a basic gradation voltage generation portion 1330 and a gamma correction portion 1331. The gradation voltage generation portion 133 generates, by the basic gradation voltage generation portion 1330 and the gamma correction portion 1331, gradation voltages VR0 to VR255 as a 256-gradation red gradation voltage group subjected to gamma correction corresponding to red components and supplies the same to the DA conversion portion 132. In addition, the gradation voltage generation portion 133 generates gradation voltages VG0 to VG255 as a 256-gradation green gradation voltage group subjected to gamma correction corresponding to green components and supplies the same to the DA conversion portion 132. In addition, the gradation voltage generation portion 133 generates gradation voltages VB0 to VB255 as a 256-gradation blue gradation voltage group subjected to gamma correction corresponding to blue components and supplies the same to the DA conversion portion 132.

Furthermore, the gradation voltage generation portion 133 generates, in each of the gradation voltages VR0 to VR255, VG0 to VG255, and VB0 to VB255, a voltage fluctuation the same as the voltage fluctuation generated in the feedback power supply voltage VDDr supplied from the display device 20.

The DA conversion portion 132 selects, for each of the display data P1 to Pn, the gradation voltage corresponding to the brightness levels represented by the display data P from one group of the red gradation voltage group (VR0 to VR255), the green gradation voltage group (VG0 to VG255) and the blue gradation voltage group (VB0 to VB255).

For example, if the display data P1 represents a brightness level of the red components, the DA conversion portion 132 selects the gradation voltage which corresponds to the brightness level represented by the display data P1 from the gradation voltages VR0 to VR255. In addition, if the display data P2 represents a brightness level of the green components, the DA conversion portion 132 selects the gradation voltage which corresponds to the brightness level represented by the display data P2 from the gradation voltages VG0 to VG255. In addition, if display data P3 represents a brightness level of the blue components, the DA conversion portion 132 selects the gradation voltage which corresponds to the brightness level represented by the display data P3 from the gradation voltages VB0 to VB255.

The DA conversion portion 132 supplies n gradation voltages selected and obtained as described above to the amplifier portion 134 as gradation voltages A1 to An for each of the display data P1 to Pn.

The amplifier portion 134 has n amplifiers (not shown) individually amplifying the gradation voltages A1 to An with a gain of one and supplies n output voltages output from these n amplifiers as gradation voltages B1 to Bn to the output switch portion 135.

The output switch portion 135 takes in the gradation voltages B1 to Bn during an on-state and supplies driving signals D1 to Dn having the gradation voltages B1 to Bn to the source lines S1 to Sn of the display device 20.

Next, a configuration of the above gradation voltage generation portion 133 is specifically described.

Figure 4:
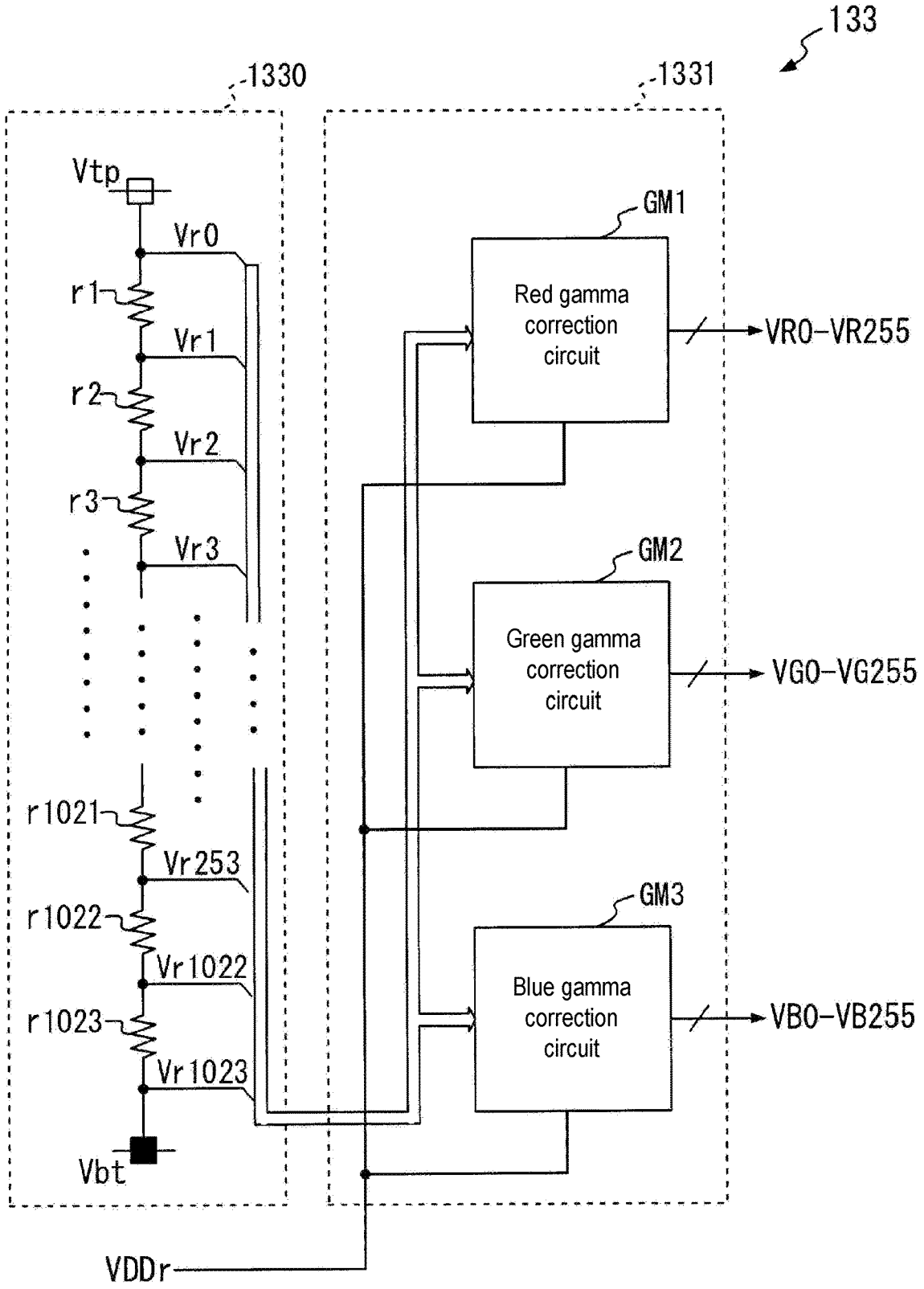
FIG. 4 is a circuit diagram showing internal configurations of a basic gradation voltage generation portion 1330 and a gamma correction portion 1331 which are included in a gradation voltage generation portion 133.

FIG. 4 is a circuit diagram showing internal configurations of the basic gradation voltage generation portion 1330 and the gamma correction portion 1331 which are included in the gradation voltage generation portion 133.

As shown in FIG. 4, the basic gradation voltage generation portion 1330 includes a ladder resistor configured by resistors r1 to r1023 being connected in series. A high voltage Vtp with a constant voltage value is applied to one end of the resistor r1 arranged in the head (tail) of the ladder resistor, and a low voltage Vbt (Vtp>Vbt) with a constant voltage value is applied to one end of the resistor r1023 arranged in the tail (head) of the ladder resistor.

The basic gradation voltage generation portion 1330 generates the high voltage Vtp applied to one end of the resistor r1 as a basic gradation voltage Vr0 which corresponds to the lowest brightness and generates the low voltage Vbt applied to one end of the resistor r1023 as a basic gradation voltage Vr1023 which corresponds to the highest brightness. In addition, the basic gradation voltage generation portion 1330 generates voltages of connection points between resistors in the resistors r1 to r1023 as basic gradation voltages Vr1 to Vr1022.

The basic gradation voltage generation portion 1330 supplies the basic gradation voltages Vr0 to Vr1023 generated as described above to the gamma correction portion 1331.

The gamma correction portion 1331 includes a red gamma correction circuit GM1, a green gamma correction circuit GM2, and a blue gamma correction circuit GM3.

The red gamma correction circuit GM1 selects, among the basic gradation voltages Vr0 to Vr1023, 256 basic gradation voltages Vr for 256 gradations having voltage values in accordance with a gamma characteristic of red. The red gamma correction circuit GM1 outputs the selected basic gradation voltages Vr for 256 gradations as the gradation voltages VR0 to VR255 subjected to the gamma correction corresponding to the red components. Furthermore, the red gamma correction circuit GM1 generates in the gradation voltages VR0 to VR255 a voltage fluctuation the same as the voltage fluctuation generated in the feedback power supply voltage VDDr.

The green gamma correction circuit GM2 selects, among the basic gradation voltages Vr0 to Vr1023, 256 basic gradation voltages Vr for 256 gradations having voltage values in accordance with a gamma characteristic of green. The green gamma correction circuit GM2 outputs the selected basic gradation voltages Vr for 256 gradations as the gradation voltages VG0 to VG255 subjected to the gamma correction corresponding to the green components. Furthermore, the green gamma correction circuit GM2 generates in the gradation voltages VG0 to VG255 a voltage fluctuation the same as the voltage fluctuation generated in the feedback power supply voltage VDDr.

The blue gamma correction circuit GM3 selects, among the basic gradation voltages Vr0 to Vr1023, 256 basic gradation voltages Vr for 256 gradations having voltage values in accordance with a gamma characteristic of blue. The blue gamma correction circuit GM3 outputs the selected basic gradation voltages Vr for 256 gradations as the gradation voltages VB0 to VB255 subjected to the gamma correction corresponding to the blue components. Furthermore, the blue gamma correction circuit GM3 generates in the gradation voltages VB0 to VB255 a voltage fluctuation the same as the voltage fluctuation generated in the feedback power supply voltage VDDr.

Furthermore, the red gamma correction circuit GM1, the green gamma correction circuit GM2, and the blue gamma correction circuit GM3 have the same circuit configuration except that the respective gamma characteristic is different.

Figure 5:
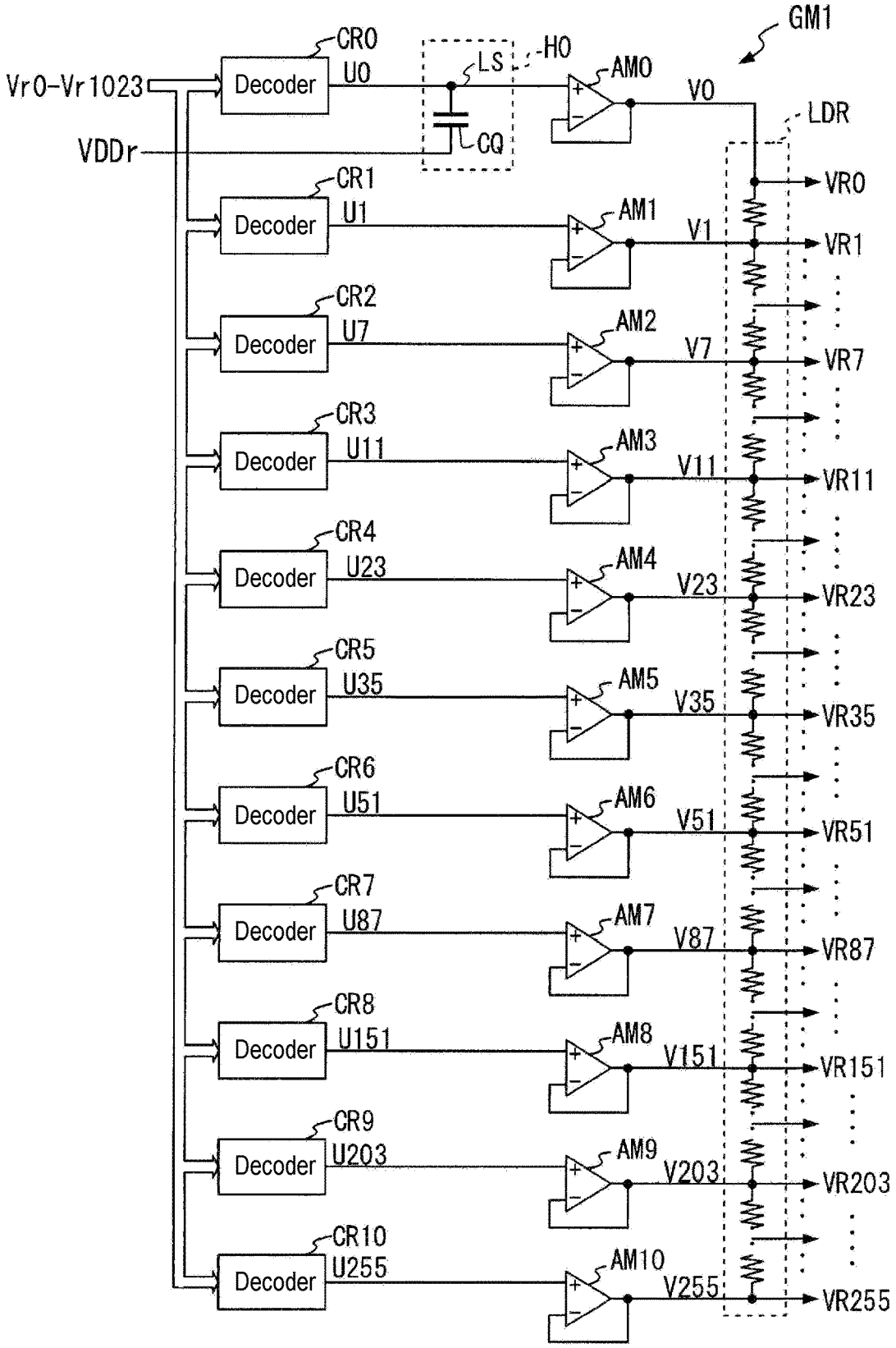
FIG. 5 is a circuit diagram showing a configuration of a red gamma correction circuit GM1.

FIG. 5 is a circuit diagram showing an internal configuration of a gamma correction circuit by extracting the red gamma correction circuit GM1 from the red gamma correction circuit GM1, the green gamma correction circuit GM2, and the blue gamma correction circuit GM3.

As shown in FIG. 5, the red gamma correction circuit GM1 includes decoders CR0 to CR10, a fluctuating voltage superposition portion H0, amplifiers AM0 to AM10, and a ladder resistor LDR configured by a plurality of resistors being connected in series.

The decoder CR0 to CR10 first selects, from the basic gradation voltages Vr0 to Vr1023, the basic gradation voltages which respectively correspond to 11 specific gradations having voltage values in accordance with the gamma characteristic and outputs the selected basic gradation voltages as representative gradation voltages U.

That is, the decoder CR0 of the red gamma correction circuit GM1 selects, from the basic gradation voltages Vr0 to Vr1023, the basic gradation voltage which is in accordance with the gamma characteristic of red and corresponds to a 0th gradation, and outputs the same as the representative gradation voltage U0. In addition, the decoder CR1 of the red gamma correction circuit GM1 selects, from the basic gradation voltages Vr0 to Vr1023, the basic gradation voltage which is in accordance with the gamma characteristic of red and corresponds to the first gradation, and outputs the same as the representative gradation voltage U1. In addition, the decoder CR2 of the red gamma correction circuit GM1 selects, from the basic gradation voltages Vr0 to Vr1023, the basic gradation voltage which is in accordance with the gamma characteristic of red and corresponds to the seventh gradation, and outputs the same as the representative gradation voltage U7.

In this way, the decoders CR0 to CR10 of the red gamma correction circuit GM1 select, from the Vr0 to Vr1023, 11 basic gradation voltages which are in accordance with the gamma characteristic of red and respectively correspond to the 0th, 1st, 7th, 11th, 23rd, 35th, 51st, 87th, 151st, 203rd, and 255th gradations. Then, the basic gradation voltages respectively corresponding to the selected 11 gradations are output as the representative gradation voltages U0, U1, U7, U11, U23, U35, U51, U87, U151, U203 and U255.

Furthermore, similarly, the decoders CR0 to CR10 of the green gamma correction circuit GM2 selects, from the Vr0 to Vr1023, the basic gradation voltages which are in accordance with the gamma characteristic of green and respectively correspond to the 0th, 1st, 7th, 11th, 23rd, 35th, 51st, 87th, 151st, 203rd, and 255th gradations. Then, the basic gradation voltages respectively corresponding to the selected 11 gradations are output as the representative gradation voltages U0, U1, U7, U11, U23, U35, U51, U87, U151, U203 and U255.

In addition, similarly, the decoders CR0 to CR10 of the blue gamma correction circuit GM3 selects, from the Vr0 to Vr1023, the basic gradation voltages which are in accordance with the gamma characteristic of blue and respectively correspond to the 0th, 1st, 7th, 11th, 23rd, 35th, 51st, 87th, 151st, 203rd, and 255th gradations. Then, the basic gradation voltages respectively corresponding to the selected 11 gradations are output as the representative gradation voltages U0, U1, U7, U11, U23, U35, U51, U87, U151, U203 and U255.

These representative gradation voltages U0, U1, U7 . . . U203 and U255 are supplied to non-inverted input terminals (+) of each of the amplifiers AM0 to AM10 via a representative gradation voltage transmission line LS for individually transmitting each of the representative gradation voltages to the ladder resistor LDR.

Each of the amplifiers AM0 to AM10 includes an operational amplifier whose output terminal and inverted input terminal are directly connected to each other, that is, a voltage follower with a gain of one. The amplifiers AM0 to AM10 amplify, at a gain of 1, the representative gradation voltages U0, U1, U7, U11, U23, U35, U51, U87, U151, U203 and U255 received by each of the non-inverted input terminals (+). The amplifier AM0 to AM10 apply amplified results as representative gradation voltages V0, V1, V7, V11, V23, V35, V51, V87, V151, V203 and V255 to one end of the resistors at 11 positions in a series resistor group included in the ladder resistor LDR.

The ladder resistor LDR outputs, as the gradation voltages VR0 to VR1023, voltages generated at one end of the resistors at 256 positions in the series resistor group due to the application of the representative gradation voltages V0, V1, V7, V11, V23, V35, V51, V87, V151, V203 and V255.

The fluctuating voltage superposition portion H0 includes a capacitor CQ. The feedback power supply voltage VDDr is applied to a first electrode of the capacitor CQ, and a second electrode of the capacitor CQ is connected to the representative gradation voltage transmission line LS which transmits the representative gradation voltage U0. The capacitor CQ has for example an electrostatic capacitance the same as the capacitor CP for holding driving signals included in each display cell PC as shown in FIG. 2 or an electrostatic capacitance corresponding to the capacitor CP.

According to the configuration, the fluctuating voltage superposition portion H0 extracts a steep voltage fluctuation amount of the feedback power supply voltage VDDr and superposes the voltage fluctuation amount on the representative gradation voltage U0. Accordingly, the fluctuating voltage superposition portion H0 suppresses, as described below, the image quality deterioration of the display device 20 accompanying the voltage fluctuation of the power supply voltage VDD.

Figure 6:
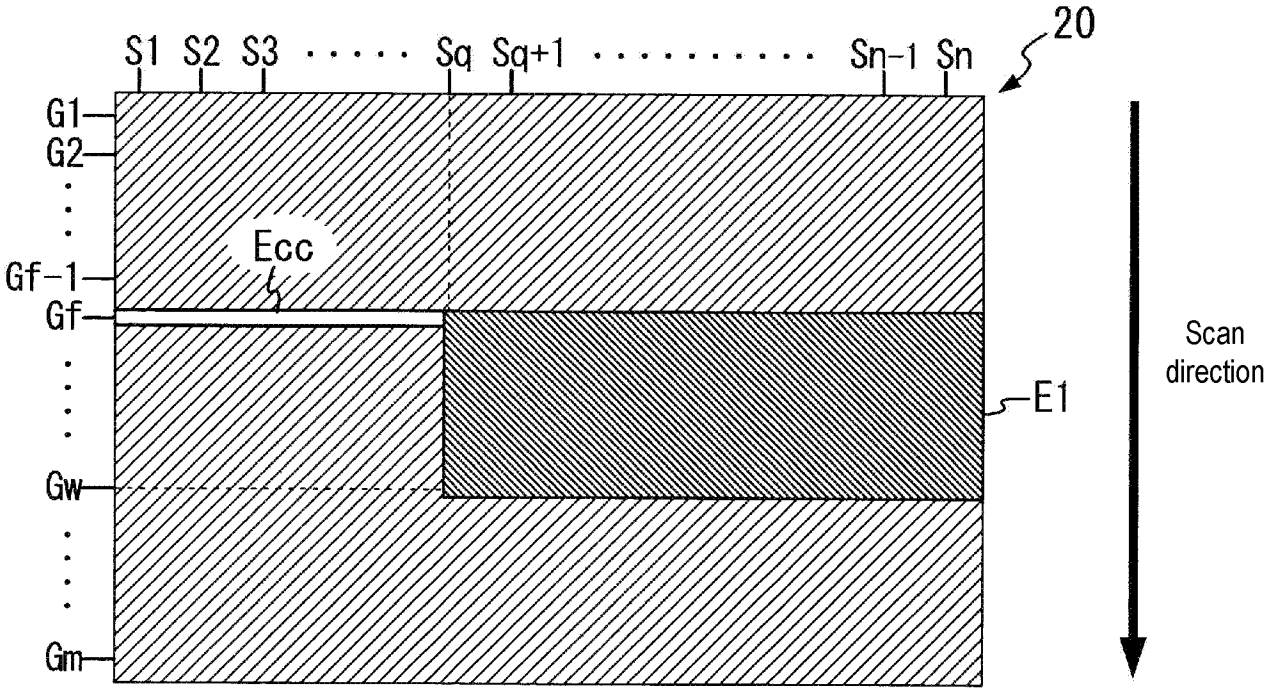
FIG. 6 is a diagram showing one example of an embodiment of a display image of a display device 20 in which image quality deterioration occurs.

FIG. 6 is a diagram showing one example of an embodiment of a display image in which there is a risk that image quality deterioration occurs along with the voltage fluctuation of the power supply voltage VDD.

In the display image shown in FIG. 6, in an image area of the display device 20, a banded area E1 extending horizontally is displayed by the lowest brightness level "0" of the full brightness range (brightness levels "0" to "255"), and the other areas are displayed by an intermediate brightness level "128". That is, in the image area of the display device 20, the area E1 in which the source lines Sq (q is an integer greater than 2 and smaller than n) to Sn intersect with the gate lines Gf (f is an integer greater than 2 and smaller than m) to Gw (w is an integer greater than f and smaller than m) is a black display portion with a brightness level 0.

Figure 7:
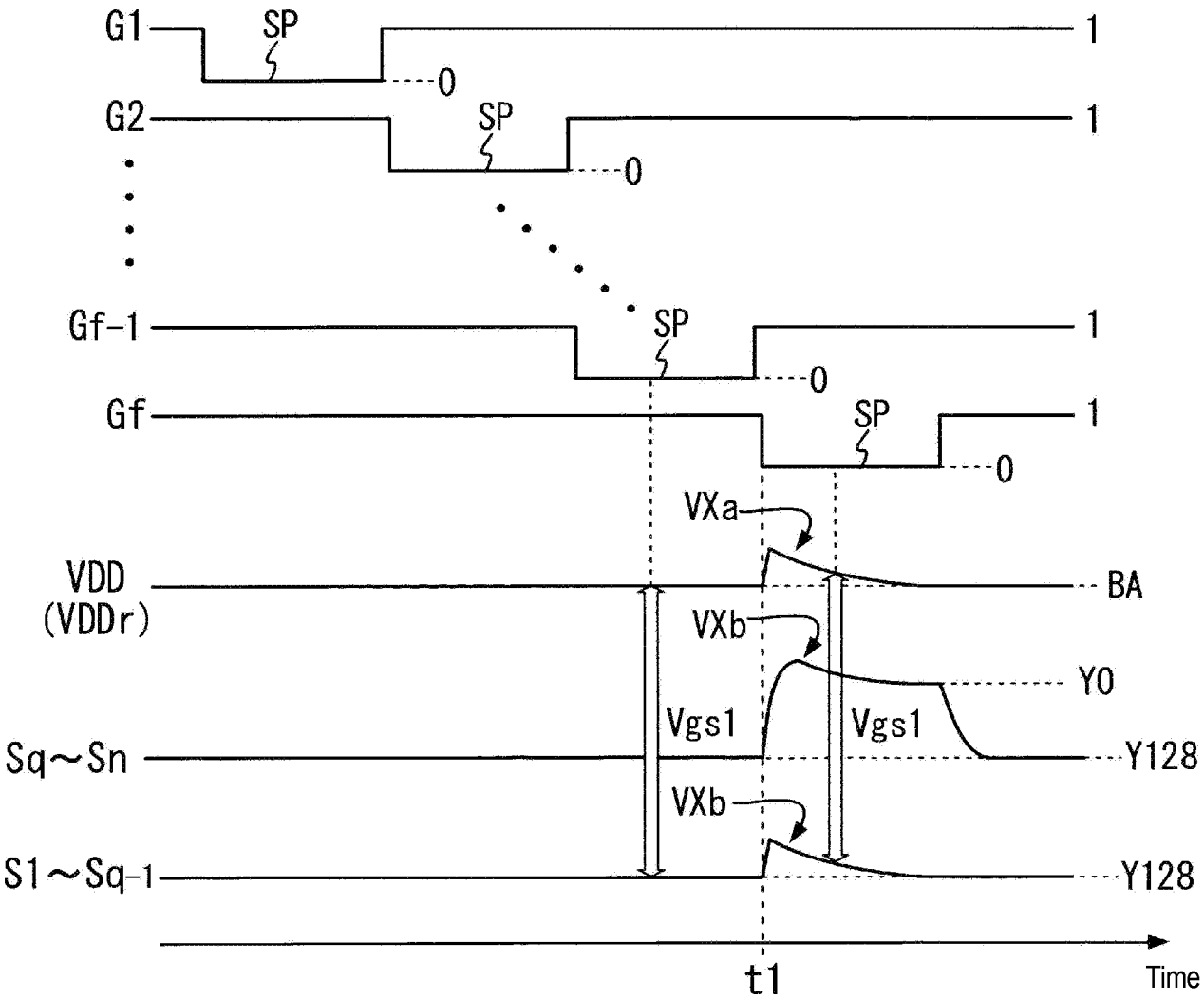
FIG. 7 is a time chart showing waveforms of pulses or signals applied to a gate line group and a source line group of the display device 20 and a voltage fluctuation of a power supply voltage VDD.

Here, when the display shown in FIG. 6 is performed, the gate driver 12 sequentially and selectively applies the selection signal including a selection pulse SP of a logic level 0 as shown in FIG. 7 to each of the gate lines G1 to Gm along a scan direction shown by an arrow in FIG. 6. Furthermore, while the gate driver 12 sequentially applies the selection pulse SP to the gate lines G1 to Gf-1 as shown in FIG. 7, the source driver 13 applies a gradation voltage Y128 which corresponds to the brightness level "128" to all the source lines S1 to Sn.

Then, as shown in FIG. 7, the gate driver 12 switches, at a time point t1, the gate line to which the selection pulse SP is applied from the gate line Gf-1 to the gate line Gf. In addition, at the time point t1, the source driver 13 shifts the gradation voltages applied to Sq to Sn of the source lines S1 to Sn from the gradation voltage Y128 corresponding to the brightness level 128 to a gradation voltage Y0 corresponding to the brightness level 0. Furthermore, the driving transistor Q2 included in each display cell PC is a p-channel type transistor, and thus as shown in FIG. 7, the gradation voltage Y0 corresponding to the lowest brightness level is higher than the gradation voltage Y128 corresponding to the intermediate brightness level.

Accordingly, immediately after the time point t1 shown in FIG. 7, inside each of the display cells PC connected to the source lines Sq to Sn, the voltage applied to the capacitor CP via the transistor Q2 is shifted from the gradation voltage V128 to the gradation voltage V0. Then, due to the transient phenomenon of the capacitor CP, a voltage fluctuation VXa is generated in which, as shown in FIG. 7, a voltage value of the power supply voltage VDD applied to the power supply line LN steeply increases and then gradually decreases to an original constant voltage value BA of the power supply voltage VDD.

Therefore, if the fluctuating voltage superposition portion H0 is not provided, inside all the display cells PC connected to the gate line Gf, gate-source voltages Vgs of the transistors Q2 increase due to the voltage fluctuation VXa generated in the power supply voltage VDD as shown in FIG. 7. Due to the increase of the gate-source voltages Vgs, driving currents greater than original driving currents by an amount corresponding to the voltage fluctuation VXa flow in the EL elements LD. Therefore, during this period, the EL element LD of each of the n display cells PC connected to the gate line Gf emits light at brightness higher than the brightness level corresponding to the gradation voltage supplied via the source line S.

In this way, in the display area of one display line corresponding to the gate line Gf, especially in an area Ecc shown in FIG. 6, image quality deterioration occurs in which a display line with higher brightness than the surrounding area is displayed.

Therefore, in order to prevent the image quality deterioration accompanying the voltage fluctuation VXa of the power supply voltage VDD, in the display apparatus 100, the fluctuating voltage superposition portion H0 shown in FIG. 5 is provided inside the gamma correction circuits (GM1 to GM3).

The fluctuating voltage superposition portion H0 includes for example the capacitor CQ as shown in FIG. 5. The feedback power supply voltage VDDr is applied to the first electrode of the capacitor CQ, and the representative gradation voltage U0 having the largest voltage value among the 11 representative gradation voltages is applied to the second electrode.

Therefore, when the voltage fluctuation VXa as shown in FIG. 7 is generated in the feedback power supply voltage VDDr, that is, the power supply voltage VDD, the capacitor CQ generates a voltage fluctuation the same as the voltage fluctuation VXa in the representative gradation voltage U0 (V0).

In this way, the ladder resistor LDR generates the gradation voltages VR0 to VR255 (VG0 to VG255, VB0 to VB255) based on the representative gradation voltages V0 under which the voltage fluctuation corresponding to the voltage fluctuation VXa is generated. Therefore, voltage fluctuations corresponding to the voltage fluctuation VXa are also generated immediately after the time point t1 shown in FIG. 7 in the gradation voltages VR0 to VR255 (VG0 to VG255, VB0 to VB255) and the driving signals D1 to Dn generated using the gradation voltage group. Therefore, as shown in FIG. 7, a voltage fluctuation VXb which is the same as the voltage fluctuation VXa generated in the power supply voltage VDD is also generated in each gradation voltage applied to the source lines S1 to Sn by the driving signals D1 to Dn.

Here, the gate-source voltage of the transistor Q2 determining the light emission brightness of the EL element LD in each display cell PC is a potential difference between the gradation voltage supplied via the source line S and the power supply voltage VDD. Therefore, even if the voltage fluctuation VXa is generated in the power supply voltage VDD as shown in FIG. 7, during this period, the voltage fluctuation VXb equivalent to the voltage fluctuation VXa is also occur in the gradation voltage, and thus the gate-source voltage of the transistor Q2 is constant no matter the voltage fluctuation is generated in the power supply voltage VDD or not.

For example, in FIG. 7, while the selection pulses SP are applied to the gate lines G1 to Gf-1, the voltage fluctuation is not generated in the power supply voltage VDD. Therefore, during this period, a gate-source voltage Vgs1 which is a difference between the power supply voltage VDD and the gradation voltage Y128 is applied to the transistor Q2, and the EL element LD emits the light of the brightness level "128".

Thereafter, as shown in FIG. 7, if the selection pulse SP is applied to the gate line Gf, the voltage fluctuation VXa is generated in the power supply voltage VDD, and the voltage fluctuation VXb the same as the voltage fluctuation VXa is generated in the gradation voltage Y128 at the same time. Therefore, if the difference between the power supply voltage VDD to which a voltage increase amount caused by the voltage fluctuation VXa is added and the gradation voltage Y128 to which a voltage increase amount caused by the voltage fluctuation VXb is added is obtained, the voltage increase amounts caused by the voltage fluctuations VXa and VXb are canceled with each other. Therefore, even if the voltage fluctuation VXa is generated in the power supply voltage VDD, the gate-source voltage Vgs1 the same as a case in which the voltage fluctuation Vxa is not generated is applied to the transistor Q2 and the EL element LD emits the light of the brightness level "128".

Therefore, according to the fluctuating voltage superposition portion H0, even if the voltage fluctuation in which the power supply voltage VDD increases temporarily is generated, a brightness level increase of the display image accompanying the increase of the power supply voltage VDD is suppressed. In this way, the image quality deterioration in which an unintentional high-brightness display line is shown, for example, in the area Ecc shown in FIG. 6 in the display image along with the voltage fluctuation of the power supply voltage VDD is suppressed.

Furthermore, the fluctuating voltage superposition portion H0 generates the voltage fluctuation which is generated in the power supply voltage VDD in the representative gradation voltage U0 after being subjected to the gamma correction. In addition, in the example shown in FIG. 5, the fluctuating voltage superposition portion H0 superposes, by employing the transient phenomenon of the capacitor CQ, the voltage fluctuation amount of the power supply voltage on the gradation voltage by the capacitor CQ only. Therefore, the image quality deterioration can be more favorably suppressed by a configuration smaller than the configuration disclosed in the literature of related art.

Moreover, in the embodiment shown in FIG. 5, the voltage fluctuation is generated, by the fluctuating voltage superposition portion H0 including the capacitor CQ, only in the representative gradation voltage U0 (V0) having the greatest voltage value among the 11 representative gradation voltages. Accordingly, by simply providing the fluctuating voltage superposition portion H0 for one system, the voltage fluctuations the same as the voltage fluctuation generated in the power supply voltage VDD may be generated in all the gradation voltages VR0 to VR255 (VG0 to VG255, VB0 to VB255).

Figure 8:
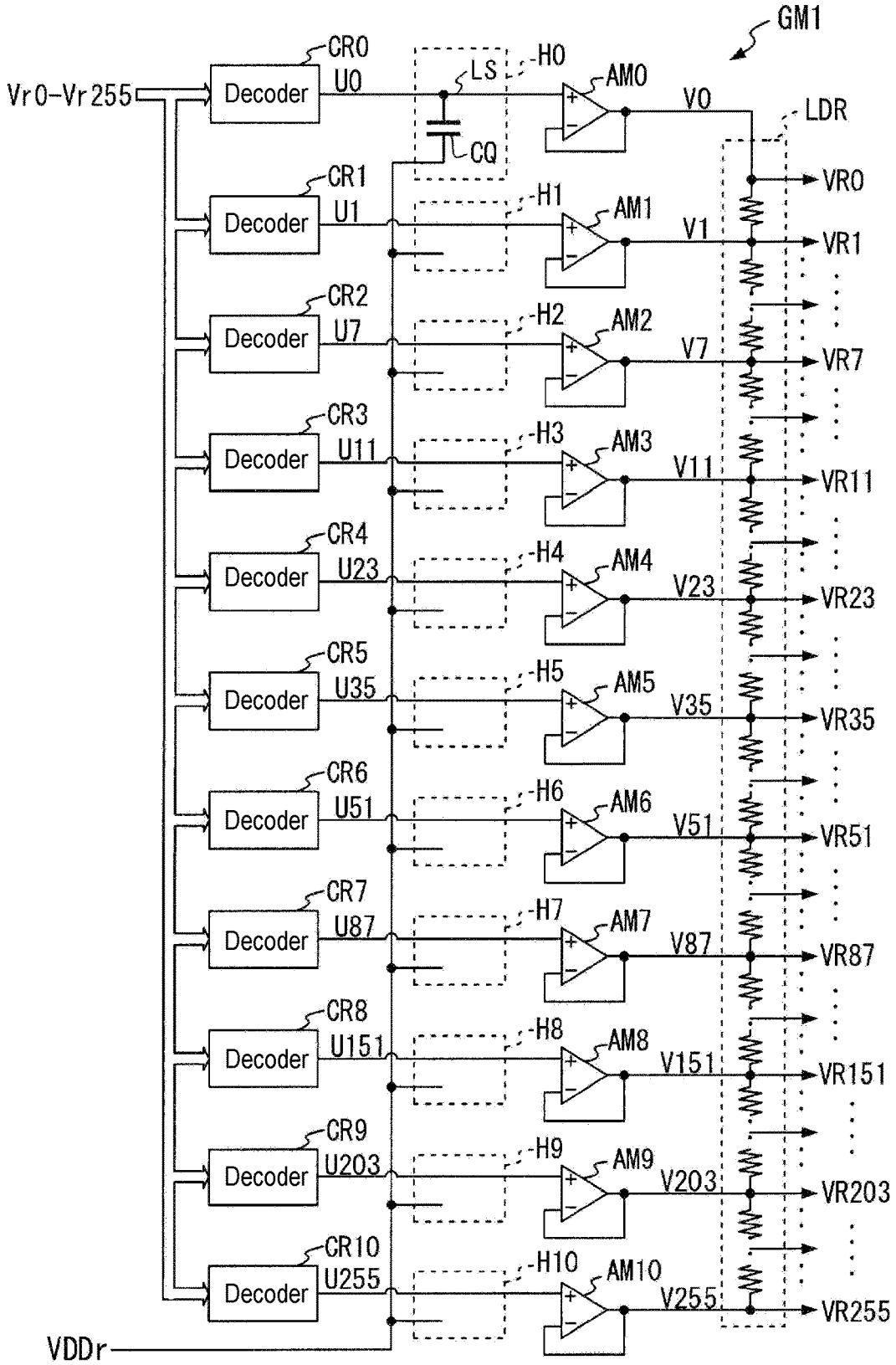
FIG. 8 is a circuit diagram showing another configuration of a red gamma correction circuit GM1.

However, as shown in FIG. 8, along with the fluctuating voltage superposition portion H0, fluctuating voltage superposition portions H1 to H10 may also be disposed for generating voltage fluctuations in the representative gradation voltages U1, U7, U11, U23, U35, U51, U87, U151, U203 and U255. Moreover, the fluctuating voltage superposition portions H1 to H10 have configurations the same as the fluctuating voltage superposition portion H0. In this way, compared with a case in which the configuration shown in FIG. 5 is employed, the voltage fluctuations the same as the voltage fluctuation generated in the power supply voltage VDD can be generated accurately in the gradation voltages VR0 to VR255 (VG0 to VG255, VB0 to VB255).

In brief, at least the fluctuating voltage superposition portion H0 is provided which generates, in at least one of the 11 representative gradation voltages supplied to the ladder resistor LDR generating the 256-gradation gradation voltage, the voltage fluctuation the same as the voltage fluctuation generated in the power supply voltage VDD.

In addition, in the embodiment shown in FIG. 5, the representative gradation voltage V0 applied to the ladder resistor LDR is generated by amplifying the voltage fluctuation generated in the power supply voltage VDD by the fluctuating voltage superposition portion H0 in the representative gradation voltage U0 by the amplifier AM0 with a gain of one.

Figure 9:
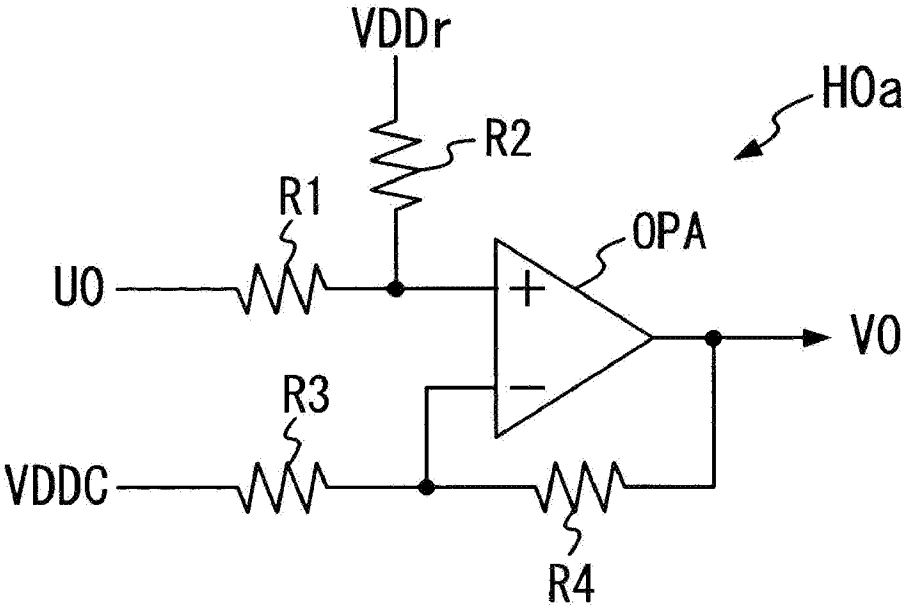
FIG. 9 is a circuit diagram showing a configuration of a fluctuating voltage superposition portion H0*a* employed in place of a fluctuating voltage superposition portion H0 and an amplifier AM0.

However, in place of the fluctuating voltage superposition portion H0 and the amplifier AM0 shown in FIG. 5, a fluctuating voltage superposition portion H0*a* having a circuit configuration as shown in FIG. 9 may also be employed.

The fluctuating voltage superposition portion H0*a* shown in FIG. 9 is configured by an operational amplifier OPA, and resistors R1 to R4 having the same resistance value. In FIG. 9, the representative gradation voltage U0 output from the decoder CR0 is supplied to the non-inverted input terminal (+) of the operational amplifier OPA via the resistor R1. In addition, the feedback power supply voltage VDDr is applied to the non-inverted input terminal (+) of the operational amplifier OPA via the resistor R2. A reference power supply voltage VDDC having a constant voltage value BA which is a reference of the power supply voltage VDD is supplied to an inverted input terminal (−) of the operational amplifier OPA via the resistor R3. In addition, the inverted input terminal (−) of the operational amplifier OPA is connected to an output terminal of the operational amplifier OPA via the resistor R4.

According to the configuration shown in FIG. 9, a voltage obtained by superposing the difference between the feedback power supply voltage VDDr and the reference power supply voltage VDDC with the representative gradation voltage U0 is supplied as a representative gradation voltage V0 to the ladder resistor LDR. That is, according to the fluctuating voltage superposition portion H0*a*, similar to the fluctuating voltage superposition portion H0 shown in FIG. 5, a voltage obtained by generating a voltage fluctuation the same as the voltage fluctuation generated in the power supply voltage VDD in the representative gradation voltage V0 can be supplied as the representative gradation voltage V0 to the ladder resistor LDR.

Therefore, in a case when the fluctuating voltage superposition portion H0*a* shown in FIG. 9 is employed in place of the fluctuating voltage superposition portion H0 and the amplifier AM0 shown in FIG. 5, image quality deterioration accompanying the voltage fluctuation of the power supply voltage VDD can also be prevented.

In addition, in the embodiment shown in FIG. 1, the terminal T1 connected to the power supply line LN supplying the power supply voltage VDD to each display cell PC is provided in the display device 20, and the source driver 13 obtains, from the terminal T1, the feedback power supply voltage VDDr corresponding to the power supply voltage VDD.

Figure 10:
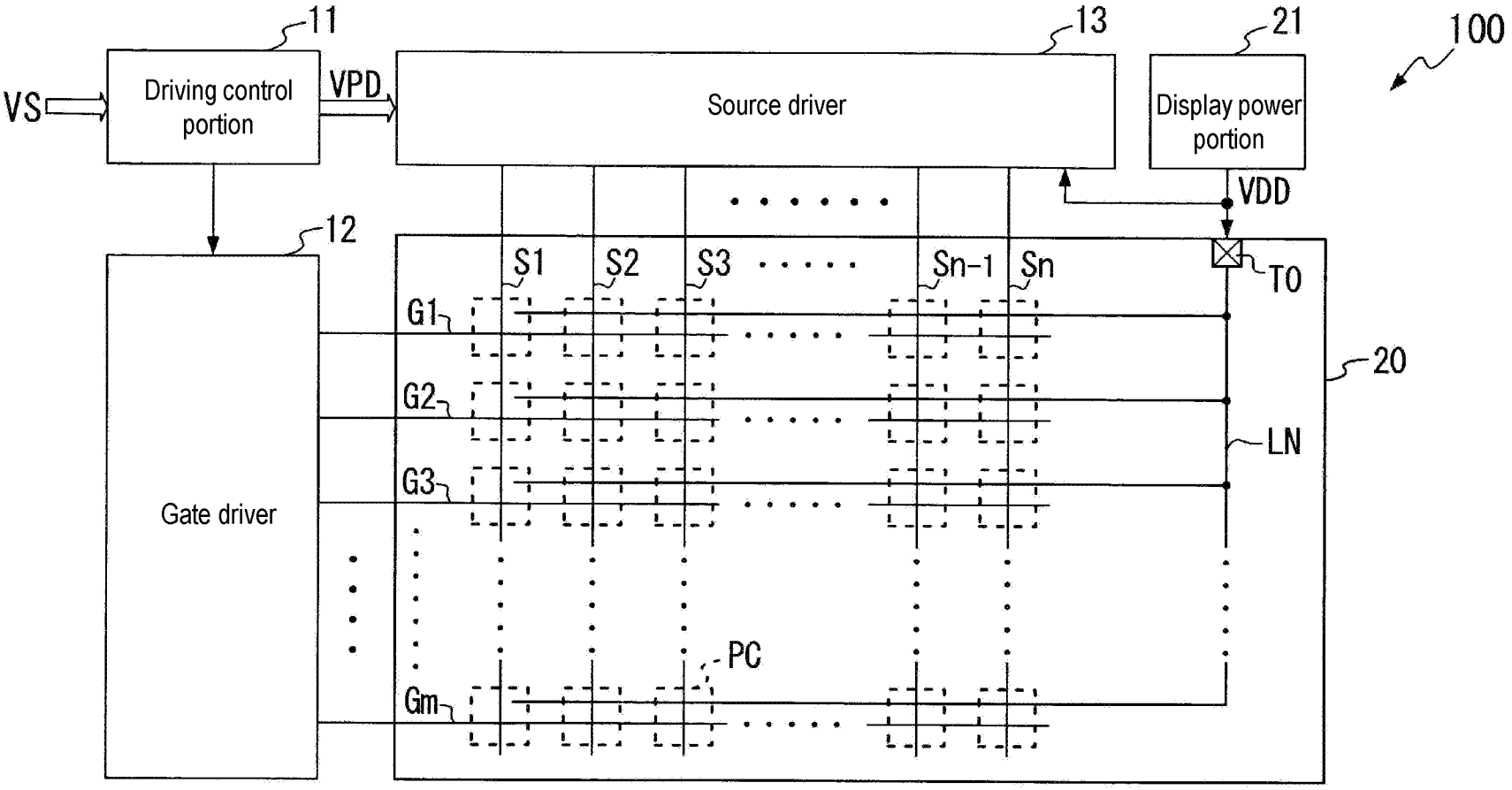
FIG. 10 is a block diagram showing another configuration of a display apparatus 100.

However, as shown in FIG. 10, the power supply voltage VDD may also be directly supplied as the feedback power supply voltage VDDr to the source driver 13 while the power supply voltage VDD output by the display power portion 21 is supplied to the terminal T0 of the display device 20. Accordingly, the capacitor CQ of the fluctuating voltage superposition portion H0 receives the power supply voltage VDD output by the display power portion 21 directly by a first electrode of the capacitor CQ itself.

Figure 11:
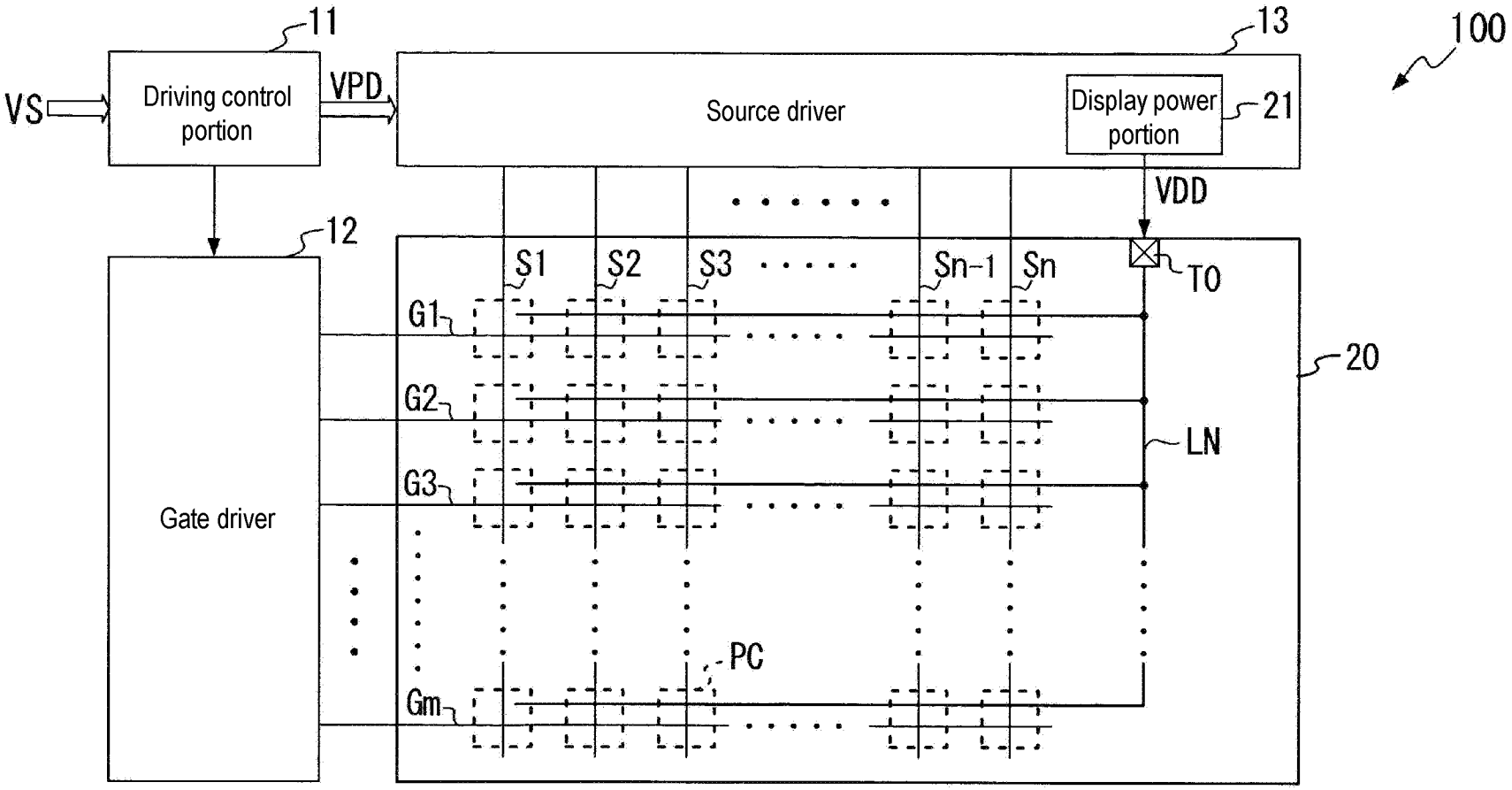
FIG. 11 is a block diagram showing another configuration of a display apparatus 100.

In addition, in the configuration shown in FIG. 10, the display power portion 21 is provided outside the source driver 13, and as shown in FIG. 11, the display power portion 21 may also be provided inside the source driver 13.

In addition, in the above embodiment, the fluctuating voltage superposition portion H0 shown in FIG. 5 or the fluctuating voltage superposition portion H0*a* shown in FIG. 9 is individually provided in each of the gamma correction circuits provided for each of the three colours (red, green, and blue), but the fluctuating voltage superposition portion may also be provided in a gamma correction circuit shared by two colours or more than four colours.

In addition, in the above embodiment, the ladder resistor LDR generates the gradation voltage groups for 256 gradations by receiving 11 representative gradation voltage groups, but the number of the representative gradation voltages is not limited to 11, and the number of the generated gradation voltages, that is, the number of the gradations is not limited to 256.

In brief, the source driver 13 for driving the display device 20 including the source lines for receiving the driving signals corresponding to the brightness level represented by the display data and the display cells PC emitting the light at the brightness corresponding to the driving signals based on the power supply voltage VDD may be any source driver as long as the following gradation voltage generation portion, driving portion, and fluctuating voltage superposition portion are included.

The gradation voltage generation portion (133) generates the first representative gradation voltage to the kth (k is an integer greater than 2) representative gradation voltage (for example, U0, U1, U7 . . . U255) in accordance with gamma characteristics, and generates the first gradation voltage to the Nth (N is an integer greater than k) gradation voltage (for example VR0 to VR255) based on the first representative gradation voltage to the kth representative gradation voltage.

The driving portion (132, 134, and 135) selects one gradation voltage corresponding to the display data from the first gradation voltage to the Nth gradation voltage and applies a signal showing the selected one gradation voltage as a driving signal to the source line.

The fluctuating voltage superposition portion (H0) generates, when a voltage fluctuation is generated in the power supply voltage (VDD), a voltage fluctuation corresponding to the voltage fluctuation in at least one (for example U0) of the first representative gradation voltage to the kth representative gradation voltage.

What is claimed is:

1. A semiconductor apparatus which drives a display device comprising source lines which receive driving signals corresponding to brightness levels represented by display data and display cells which emit light at brightness corresponding to the driving signals received by the source lines based on a power supply voltage, the semiconductor apparatus comprising:

a gradation voltage generation portion generating a first representative gradation voltage to a kth representative gradation voltage in accordance with gamma characteristics and generating a first gradation voltage to an Nth gradation voltage based on the first representative gradation voltage to the kth representative gradation voltage, wherein k is an integer greater than 2 and N is an integer greater than k;

a driving portion selecting one gradation voltage corresponding to the display data from the first gradation voltage to the Nth gradation voltage and applying a signal representing the selected one gradation voltage as the driving signal to the source lines; and a fluctuating voltage superposition portion generating, when a voltage fluctuation is generated in the power supply voltage, a voltage fluctuation corresponding to the voltage fluctuation in at least one of the first representative gradation voltage to the kth representative gradation voltage, wherein the fluctuating voltage superposition portion comprises:

an operational amplifier;

a first resistor having one end to which one of the first representative gradation voltage to the kth representative gradation voltage is applied and the other end connected to a non-inverted input terminal of the operational amplifier;

a second resistor having one end to which the power supply voltage is applied and the other end connected to the non-inverted input terminal of the operational amplifier;

a third resistor having one end to which a reference power supply voltage which is a reference of the power supply voltage is applied and the other end connected to an inverted input terminal of the operational amplifier; and a fourth resistor having one end connected to the inverted input terminal of the operational amplifier and the other end connected to an output terminal of the operational amplifier.

2. The semiconductor apparatus according to claim 1, wherein the gradation voltage generation portion comprises:

a basic gradation voltage generation portion generating a plurality of basic gradation voltages having voltage values different from each other;

a red gamma correction circuit setting k of the plurality of basic gradation voltages in accordance with a gamma characteristic for red as the first representative gradation voltage to the kth representative gradation voltage for red and generating the first gradation voltage to the Nth gradation voltage for red based on the first representative gradation voltage to the kth representative gradation voltage for red;

a green gamma correction circuit setting k of the plurality of basic gradation voltages in accordance with a gamma characteristic for green as the first representative gradation voltage to the kth representative gradation voltage for green and generating the first gradation voltage to the Nth gradation voltage for green based on the first representative gradation voltage to the kth representative gradation voltage for green; and a blue gamma correction circuit setting k of the plurality of basic gradation voltages in accordance with a gamma characteristic for blue as the first representative gradation voltage to the kth representative gradation voltage for blue and generating the first gradation voltage to the Nth gradation voltage for blue based on the first representative gradation voltage to the kth representative gradation voltage for blue; and the fluctuating voltage superposition portion generates, in each of the red gamma correction circuit, the green gamma correction circuit, and the blue gamma correction circuit, the voltage fluctuation corresponding to the voltage fluctuation generated in the power supply voltage in at least one of the first representative gradation voltage to the kth representative gradation voltage.

3. The semiconductor apparatus according to claim 1, wherein the fluctuating voltage superposition portion generates a voltage fluctuation corresponding to the voltage fluctuation generated in the power supply voltage in one representative gradation voltage having the greatest voltage value among the first representative gradation voltage to the kth representative gradation voltage.

4. The semiconductor apparatus according to claim 1, wherein the display cell comprises:

a light emission element;

a holding capacitor in which the driving signal received by the source line is received by a first electrode of the holding capacitor and the power supply voltage is applied to a second electrode; and a transistor in which the driving signal is supplied to a gate while the power supply voltage is applied to a source, and a current corresponding to the driving signal is supplied to the light emission element; and wherein the capacitor included in the fluctuating voltage superposition portion has an electrostatic capacitance corresponding to an electrostatic capacitance of the holding capacitor.

5. The semiconductor apparatus according to claim 1, wherein the display device comprises a power supply line supplying the power supply voltage to each of the plurality of display cells and terminals connected to the power supply line; and the first electrode of the capacitor is connected to the terminals.

6. The semiconductor apparatus according to claim 1, wherein the fluctuating voltage superposition portion is disposed inside the gradation voltage generation portion.

7. A semiconductor apparatus which drives a display device comprising source lines which receive driving signals corresponding to brightness levels represented by display data and display cells which emit light at brightness corresponding to the driving signals received by the source lines based on a power supply voltage, the semiconductor apparatus comprising:

a gradation voltage generation portion generating a first representative gradation voltage to a kth representative gradation voltage in accordance with gamma characteristics and generating a first gradation voltage to an Nth gradation voltage based on the first representative gradation voltage to the kth representative gradation voltage, wherein k is an integer greater than 2 and N is an integer greater than k;

a driving portion selecting one gradation voltage corresponding to the display data from the first gradation voltage to the Nth gradation voltage and applying a signal representing the selected one gradation voltage as the driving signal to the source lines;

a fluctuating voltage superposition portion generating, when a voltage fluctuation is generated in the power supply voltage, a voltage fluctuation corresponding to the voltage fluctuation in at least one of the first representative gradation voltage to the kth representative gradation voltage; and a first line to a kth line for transmitting the first representative gradation voltage to the kth representative gradation voltage, wherein the fluctuating voltage superposition portion comprises:

a plurality of operational amplifiers connected to each of the first line to the kth line; and a capacitor in which the power supply voltage is applied to a first electrode of the capacitor and a second electrode of the capacitor is connected between one of the first line to the kth line and one of the plurality of operational amplifiers.

* * * * *